US006092902A

United States Patent [19]

Weber et al.

[11] Patent Number: 6,092,902

[45] Date of Patent: Jul. 25, 2000

[54] ILLUMINATED SERRATED WHEEL

[75] Inventors: Adam Weber, Bietigheim-Bissingen; Andreas Ballmann, Remseck, both of Germany

[73] Assignee: ITT Manufacturing Enterprises, Inc., Wilmington, Del.

[21] Appl. No.: 09/142,040

[22] PCT Filed: Oct. 9, 1997

[86] PCT No.: PCT/EP97/05561

§ 371 Date: Oct. 30, 1998

§ 102(e) Date: Oct. 30, 1998

[87] PCT Pub. No.: WO98/29789

PCT Pub. Date: Jul. 9, 1998

[30] Foreign Application Priority Data

Dec. 28, 1996 [DE] Germany ..... 196 54 651

[51] Int. Cl.[7] ..... F21V 33/00

[52] U.S. Cl. ..... 362/28; 362/29; 362/30; 362/31; 362/32

[58] Field of Search ..... 362/28, 29, 30, 362/31, 32, 37, 19, 20, 21, 23, 24, 26

[56] References Cited

U.S. PATENT DOCUMENTS

| | | | |
|---|---|---|---|
| 3,334,958 | 8/1967 | Appeldorn | 362/31 |
| 4,141,058 | 2/1979 | Mizohata et al. | 362/32 |
| 4,342,908 | 8/1982 | Henningsen et al. | 250/227 |
| 4,371,916 | 2/1983 | De Martino | 362/31 |
| 4,583,151 | 4/1986 | Nagel | 362/29 |
| 5,288,957 | 2/1994 | Swaybill | 200/317 |

FOREIGN PATENT DOCUMENTS

| | | |
|---|---|---|
| 2593618 | 7/1987 | France . |
| 2642183 | 7/1990 | France . |
| 2613966 | 10/1977 | Germany . |
| 2741492 | 3/1979 | Germany . |
| 8436320 | 5/1986 | Germany . |
| 3808770 | 9/1989 | Germany . |
| 4109288 | 9/1992 | Germany . |
| 686960 | 2/1953 | United Kingdom . |

OTHER PUBLICATIONS

German Patent Office Search Report dated Jul. 21, 1997 for German patent application No. 196 54 651.6.

PCT International Search Report dated Mar. 25, 1998 for PCT/EP97/05561.

*Primary Examiner*—Cassandra Spyrou
*Assistant Examiner*—Mohammad Y. Sikder
*Attorney, Agent, or Firm*—J. Gordon Lewis

[57] ABSTRACT

The present invention relates to a control knurl for the rotary adjustment of a potentiometer in an automotive vehicle which minimizes light loss of the light guide in a control knurl. The light guide of the control knurl reflects the light from inside onto the peripheral surface of the control knurl. A bright protective coating encompasses the light guide and reflects the beams of light which emit from the boundary surface of the light guide. Light loss is also avoided by not applying protective coating on mirror surfaces which redirect the light.

24 Claims, 1 Drawing Sheet

ILLUMINATED SERRATED WHEEL

BACKGROUND OF THE INVENTION

1. Field of the Invention

The present invention relates to a control knurl for actuating an appliance, in particular for the rotary adjustment of a potentiometer in automotive vehicles.

2. Description of the Art

A knurl of this type is disclosed in the applicant's German patent application No. 38 08 770. Control knurls of this type must permit being manipulated even if the passenger compartment is dark. Therefore, the dial setting of the potentiometer is illuminated from the inside. Such illumination permits not only recognizing the positioning of the control knurl in the dark but also its respective setting. If needed, adjustment changes can be made.

Because the number of operable adjustment elements on the control panel is constantly rising, it is desired to minimize the energy needed for the dial illumination, while sufficient visibility is ensured in addition. Therefore, one requirement is to minimize, to the extent possible, any light loss which the beams of light suffer on their way to the dial indicating instrument.

SUMMARY OF THE INVENTION

The present invention is a control knurl. The principle of the present invention is directed to minimizing light loss of the light guide inside the knurl by largely coating the outside surfaces of the light guide with a reflecting (white) plastic coating. In this arrangement, that surface is left blank which is used to introduce the light into the light guide. Under certain circumstances, other surfaces are also left blank, in case this is considered appropriate for the mode of operation of the control knurl.

To minimize the loss surfaces of the light guide where the light might leak inadvertently, the light guide should have a shape which is as uncomplicated as possible. In the present case, light beams which enter axially into the light guide are emitted at a radially circumferential surface. The light beams are then introduced into the cross-sectional surface of a first portion of the light guide and redirected radially outwardly through a second portion until the light beams extend radially outwardly within a third portion. It is preferred that the individual portions are spatially circumferential, with the result that a large number of light-scattering surfaces are eliminated, which would prevail, for example, if the second portion consisted of generally radially extending struts.

Further, the outwardly circumferential surface permits the provision of an inwardly illuminated circumferential strip on the peripheral contour of the knurl on which appropriate markings can be made at any location desired.

Accordingly, the second portion has a circumferential surface which is inclined by 45 degrees with respect to the axis of light beam entry. The inside peripheral surface is configured so that the light beams which are introduced into the light guide in parallel to the axis of rotation of the control knurl are reflected on the inside peripheral surface of the truncated cone. Thus, the angular position of the wall is chosen so that it acts like a mirror for the beams which are impinged within the light guide. This is important, as will still be explained hereinbelow, inasfar as there is no need to apply a (white) protective coating at this point.

To prevent disturbing beams of light from being directed into the light guide from the outside, a second, preferably black, coating covers the first coating. However, it is important that the dark, second coating is not in direct contact with the light guide, because it would not reflect the beams of light which emit from the light guide, but rather take them up and become warm or heated as a result. On the other hand, the advantage of the dark, second coating is that soiling of the control knurl, due to its usage, is not visible on its surface. Still another special advantage of the second coating is that the coating can additionally be configured as an operating surface. It is preferred that this operating surface is a knurl which is adjacent to the illuminated dial and mechanically connected to it. By turning the knurl surface, which has the shape of a cylinder jacket, the dial is also turned so that the setting of the electrical appliance, for example, a potentiometer, is visible from the illuminated value set.

Preferably, the knurl surface is cast to the second coating and made of the same material. Through a ring knob, it is prevented that the operating surface, when worn off, changes its color in points. Such a risk could be imminent if the operating surface were made of the first, light plastic material and the operating surface were only overcoated with a dark color.

Black-ink viscous plastics may be used as a material for the knurl and the second coating. The choice of a highly resistant material is also important. According to these features, a toothed wheel which can be used to drive a gearing is still machined into the second plastic coating. This permits adapting the rotary movement of the control knurl to any desired rotary movement for the operation of an electrical unit. This increases the versatility of the control knurl.

To provide a durable connection between the second coating and the first coating or the light guide, at least one web is used as a preferred aspect of the present invention.

The rigidity of the second plastics may further be utilized for shaping a support element for the mounting support of the control knurl in addition. The inside surface or the outside surface of the bearing ring can be used for the mounting support.

Tests have shown that the setting dial on the control knurl is best visible in the dark if the markings include illuminated symbols or figures. Accordingly, the dial display which encompasses the peripheral surface of the light guide is coated with black varnish, and the symbols and marks desired as illuminated markings are made visible by removing the varnish or leaving parts blank. This may, e.g., be carried out by laser exposure. To increase the visibility, the circumferential peripheral surface of the light guide is coated with a thin coating of the white, first plastics, and black varnish is only then applied. The white, first coating illuminated from the inside will radiate outwardly by way of markings where the varnish coating was removed from the first, white plastic coating.

One important solution involves improving the mirror effect on the specular limit boundary which is used to redirect the beams that are introduced in an axial direction into radially extending beams. In this way, a largest possible portion of the introduced beams is transported to the circumferential surface of the control knurl. The improved mirror effect of the boundary surface contributes greatly to avoiding light loss in the deflection area.

The loss of light energy can be further reduced when the light guide is kept free of the protective coating on the boundary surfaces used for mirroring. This should be done in particular in the area of the boundary surface where the light beams which enter in the vicinity of the longitudinal axis of the light guide are redirected in a radial direction.

BRIEF DESCRIPTION OF THE DRAWING

One embodiment of the present invention will be explained hereinbelow making reference to the accompanying drawing. In the drawing.

DESCRIPTION OF THE PREFERRED EMBODIMENT

Figure 1:
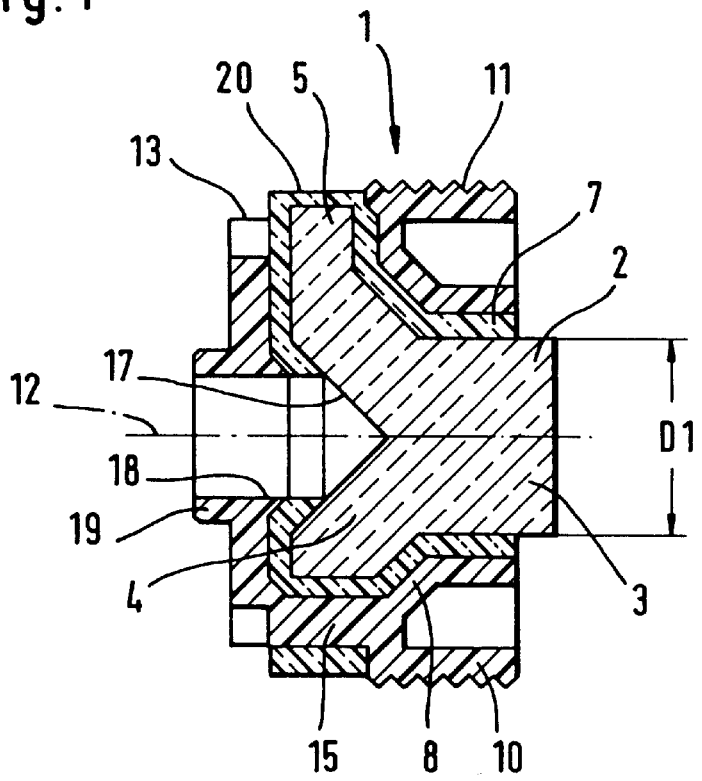
FIG. 1 is a cross-sectional view of a control knurl according to the present invention.
Figure 2:
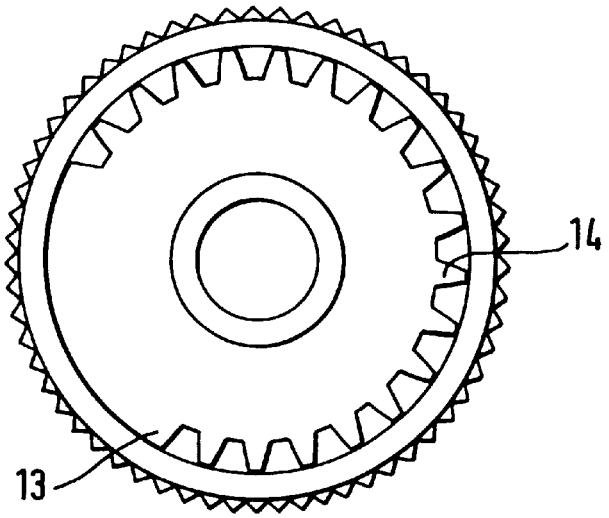
FIG. 2 is a side view of the control knurl of FIG. 1.

The FIG. 1 embodiment shows a control knurl 1 in a cross-section. The core of the control knurl 1 is a light guide 2 that is composed of three portions. The first portion 3 has the shape of a circular cylinder with the diameter D1. The first portion is succeeded by a second portion 4 which generally has the shape of a hollow truncated cone. Adjacent to the truncated cone is a third portion 5 which generally has the shape of a circular ring. It is important to the present invention that the outside surface of the light guide 2 is largely coated by a protective coating of white plastic which reflects the light beams directed to the boundary coating of the light guide, thereby preventing any inadvertent escape of light from the light guide. The light guide 2 can be made highly transparent from Makrolon, and Makrolon White can be used for protective coating 7. Protective coating 7, in turn, is covered by a second coating 8 which can consist of dark or black dyed Pocan. The second coating 8 prevents the entry of extraneous light into the light guide 2 where it is not desired. Second coating 8 includes a circumferential projection 10 which has the shape of a ring knob and is provided with a milled edge 11. The outside circumferential surface of the ring knob with the milled edge 11 is used as an actuating surface for the control knurl which is rotatable (not shown) about an axis of rotation 12. The plastic material used for making the ring knob 10 or the second coating 8 may be Pocan Black. An associated electrical appliance is adjusted in an appropriate manner by actuating the control knurl 1. Such adjustment is effected by way of a gearing in the present embodiment. A gear wheel 13 machined into the second coating 8 interacts with the gearing. The tooth configuration 14 to be seen in the FIG. 2 embodiment can extend around a full circle, or only about part of a circular arc. To rigidly connect the second coating 8 to the protective coating 7 and the light guide 2, one or more webs 15 are provided which project through the protective coating 7 or the light guide 2.

One important feature of the present invention includes the production of the inside peripheral surface 17 of the second portion 4 which extends in an axial direction over the diameter D1 so that the total light beams which enter into the diameter D1 are reflected from the inside peripheral surface 17 of the second portion 4. This boundary surface acts like a mirror. Therefore, it is not suitable to cover the peripheral surface with protective coating 7. The inside peripheral surface 17 of a conical recess in the second portion 4, thus, acts as a reflecting boundary surface by which the beams of light which enter into the portion 3 in the direction of the longitudinal axis 12 are reflected in a radial direction to the annular portion 5. Thus, the mirror effect of the conical recess in the second portion 4, the boundary surface 17 of which acts as a mirror of the beams of light, may be greatly improved because a boundary surface between the air and the material of the air guide is produced. The great reflecting ability of the boundary surface 17 is especially important in the area close to the longitudinal axis 12 because here is the center of the beams of light introduced into the first portion 3.

In this way it is possible to provide a bore surface 18 with respect to the two coatings 7, 8 which can be used as a pivot bearing for the control knurl 1. A bearing ring 19, shaped to the second coating permits increasing the bore surface still further and, thus, reduces the bearing surface or the load on the bearing surface.

It can be seen in FIG. 1 that the outside peripheral surface 20 of the protective coating 7 is not covered by another coating. This outside peripheral surface is the base surface of a dial. In order that it is as dark as the ring knob 10 with its milled edge 11, the peripheral surface 20 is entirely covered by a black varnish (not shown). The desired dial symbols or letters or figures are provided in the varnish by way of laser exposure. The symbols will appear the brighter, the deeper they are worked out from the varnish and the underlying protective coating. However, part of the protective coating 7 will normally be maintained to make the desired symbols appear bright and glare-free. In this sense, the protective coating acts as a diffusing lens which is conventional in optical systems and evenly distributes the illuminating power.

In total, it makes sense to keep the entry surface into the light guide as large as possible. This entry surface is defined by the diameter D1 which, in the present embodiment, is in the range of half the diameter of the outside peripheral surface 20, yet somewhat smaller in the present case. Further, it is appropriate to position the webs 15 in areas where no dial symbol will appear because the light guide is impaired in these areas, as can be seen in the drawing.

What is claimed is:

1. A control knurl for actuating an electrical appliance which includes at least one zone at a lateral periphery of the knurl for illumination from the interior of the knurl by means of a light guide, wherein light beams are introduced into the light guide in an area of an axis of the knurl, characterized in that the light guide is generally coated with a bright, protective coating with the exception of a surface that is used to introduce the light beams; and wherein the light guide includes first, second and third portions, the first portion arranged centrally to a longitudinal axis, and being substantially annular, the second portion having a shape of a truncated hollow cone for reflecting light beams extends in an axial direction, the third portion having a shape of a circular ring positioned adjacent to the truncated cone, and said light beams enter into the first portion in an longitudinal direction of said longitudinal axis to said third portion.

2. The control knurl as claimed in claim 1, characterized in that the light guide includes three portions, wherein the first portion is arranged centrally to the axis of rotation of the knurl, wherein the third portion is substantially annular, wherein the outside peripheral surface of a ring portion extends into a zone of the knurl adapted to be illuminated, and wherein a circumferential second portion connects the first portion to the third portion.

3. A control knurl as claimed in claim 2, characterized in that the second portion generally has the shape of a truncated hollow cone, wherein a truncated roof surface corresponds to a cross-sectional surface of the first portion, wherein peripheral surfaces of the truncated cone are included by substantially 45 degrees in relation to the axis of rotation, and a wall thickness of the cone approximately equals the width of the first portion.

4. The control knurl as claimed in claim 3, characterized in that an inside peripheral surface of the truncated cone is generally free from the protective coating.

5. The control knurl as claimed in claim 1, characterized in that the knurl has a grip surface made of a second plastic, and in that the protective coating made of a first plastic is largely covered by a second coating made of the second plastic.

6. The control knurl as claimed in claim 5, characterized in that shaped on the second coating is a ring knob which is also made of the second plastic and has substantially the same outside diameter as the annular third portion.

7. The control knurl as claimed in claim 5, characterized in that a tooth configuration is inserted into the second coating on the side of the control knurl opposite to the surface for the entry of light.

8. The control knurl as claimed in claim 5, characterized in that the control knurl includes at least one web made up of the second plastic which extends in an axial direction and is radially offset in relation to the axis of rotation.

9. The control knurl as claimed in claim 5, characterized in that a bearing ring made up of a second plastic is shaped on the second coating on the side of the control knurl opposite to the entry of light.

10. The control knurl as claimed in claim 5, characterized in that the protective coating is coated with a shielding light-proof varnish on its peripheral surface encompassing the third portion.

11. A control knurl for actuating an electrical appliance, which includes at least zone at a lateral periphery of the knurl for illumination from the interior of the knurl by means of a light guide, wherein light beams are introduced into the light guide in an area of an axis of the knurl, characterized in that the light guide is provided with the coaxial conical recess in order to redirect the axially introduced light beams into generally radially directed light beams, a peripheral recess surface being as a reflecting boundary surface to redirect the light beams, and in that a boundary surface is substantially free from an enwrapping protective coating; and wherein the light guide includes first, second and third portions, the first portion arranged centrally to the longitudinal axis, and being substantially annular the second portion having a shape of a truncated hollow cone for reflecting light beam extends in an axial direction, the third portion having a shape of a circular ring positioned adjacent to the truncated cone, and said light beams enter into the first portion in a longitudinal direction of said longitudinal axis to said third portion.

12. The control knurl as claimed in claim 11, characterized in that at least one radially inward area of the boundary surface which is adjacent to the axis is not covered by a protective coating.

13. A control knurl for actuating an electric device comprising:

a light guide having at least one lateral peripheral zone for illumination from an interior of the light guide by light beams introduced into the light guide along a longitudinal axis of the light guide;

a first protective coating covering the light guide except for a surface used to introduce the light beams into the light guide, and wherein the light guide includes first, second and third portions the first portion arranged centrally to the longitudinal axis, and being substantially annular, the second portion having a shape of a truncated hollow cone for reflecting light beam extends in an axial direction, the third portion having a shape of a circular ring positioned adjacent to the truncated cone, and said light beam enters into the first portion in longitudinal direction of said longitudinal axis to said third portion.

14. The control knurl of claim 13 wherein:

an outside peripheral surface of the third portion extending into a zone adapted to be illuminated, and wherein the second portion connects the first portion.

15. The control knurl of claim 14 wherein:

the truncated cone corresponding to the cross-sectional surface of the first portion, the peripheral surface of the truncated cone inclined by substantially 45 degrees in relation to the longitudinal axis, and a wall thickness of the truncated cone approximately equaling the width of the first portion.

16. The control knurl of claim 14 wherein:

an inside peripheral surface of the truncated cone is free from the first protective coating.

17. The control knurl of claim 14 further comprising:

a grip surface formed of a second coating, the first protective coating substantially covered by the second coating.

18. The control knurl of claim 17 further comprising:

an annular knob shaped on the second coating and made of the same material as the second coating, the knob having approximately the same outside diameter as the third portion.

19. The control knurl of claim 17 further comprising:

a tooth configuration disposed in the second coating on a side of the right guide opposite to the surface for entry of light.

20. The control knurl of claim 17 further comprising:

at least one web formed of the second material extending in an axial direction radially offset in relation to the longitudinal axis.

21. The control knurl of claim 17 further comprising:

a bearing ring formed of the second material and shaped on the second coating on the side of the light guide opposite to the surface for the entry of light.

22. The control knurl of claim 17 further comprising:

the first protective coating coated with a light-proof material on a peripheral surface encompassing the third portion.

23. A control knurl for actuating an electric device by rotary adjustment of a potentiometer comprising:

at least one zone at a lateral periphery of the knurl for illumination from the interior by means of a light guide, light beams introduced into the light guide in an area of a longitudinal axis of the knurl;

the light guide having a coaxial conical recess to redirect the axially introduced light beams into generally radially directed light beams, a surface of the conical recess acting as a reflecting houndary surface to redirect the light beams;

the boundary surface of the conical recess is substantially free from the first protective coating; and wherein said light guide includes first, second and third portions, the first portion arranged centrally to the longitudinal axis, and being substantially annular, the second portion having a shape of a truncated hollow cone for reflecting light beam extends in an axial direction, the third portion having a shape of a circular ring positioned adjacent to the truncated cone, and said light beam enters into the first portion in longitudinal direction of said longitudinal axis to said third portion.

24. The control knurl of claim 23 wherein:

at least one radially inward area of the boundary surface which is adjacent to the longitudinal axis is not covered by the first protective coating.

* * * * *